US005233816A

United States Patent [19]

Moriya et al.

[11] Patent Number: 5,233,816

[45] Date of Patent: Aug. 10, 1993

[54] LEAF PAPER BUNDLING APPARATUS

[75] Inventors: Koichi Moriya; Minoru Onozawa; Shigemi Kobayashi; Osamu Ito; Masahiko Nishimura; Masato Ono, all of Himeji, Japan

[73] Assignee: Glory Kogyo Kabushiki Kaisha, Hyogo, Japan

[21] Appl. No.: 839,895

[22] Filed: Feb. 25, 1992

[30] Foreign Application Priority Data

Oct. 28, 1991 [JP] Japan ..... 3-88377[U]
Dec. 26, 1991 [JP] Japan ..... 3-107556[U]

[51] Int. Cl.[5] ..... B65B 27/08

[52] U.S. Cl. ..... 53/588; 53/589; 100/27

[58] Field of Search ..... 53/74, 137.2, 588, 589, 53/590, 399, 419, 586; 100/27, 33 PB

[56] References Cited

U.S. PATENT DOCUMENTS

| | | | |
|---|---|---|---|
| 3,729,886 | 5/1973 | Lucas et al. | 53/74 X |
| 4,014,731 | 3/1977 | Muto | 53/588 X |
| 4,424,660 | 1/1984 | Sato et al. | 53/588 X |
| 4,483,124 | 11/1984 | Ohba et al. | 53/588 X |
| 4,492,072 | 1/1985 | Miyano et al. | 53/588 X |
| 4,539,789 | 9/1985 | Miyano et al. | 53/588 X |
| 4,718,220 | 1/1988 | Van Rosendal et al. | 53/137.2 X |
| 5,126,002 | 6/1992 | Iwata et al. | 53/588 X |

*Primary Examiner*—John Sipos
*Assistant Examiner*—Daniel Moon
*Attorney, Agent, or Firm*—Wenderoth, Lind & Ponack

[57] ABSTRACT

A leaf panel bundling apparatus allows leaf paper to be bundled to be inserted into the apparatus from either the front or the top of the apparatus. The leaf paper bundling apparatus wraps a tape around many leafs of paper which have been stacked, uses a cutter to cut the wrapped tape and uses a thermo-adhesion head to adhere the ends of the tape to one another so as to bundle the leaf paper. A leaf paper insertion opening portion has a slit extending to a location above the front portion of the main apparatus unit and into which leaf paper can be inserted from the front or top of the apparatus. A leaf paper regulation device receives a leaf paper lower edge and a leading edge which is the edge to be located furthest from the front of the main apparatus unit after insertion. A tape supply device supplies tape to be wrapped around the periphery of the leaf paper, applies tension to and tightens the wrapped tape. A tape winding device has an arm which can hold an end of the tape fed from the tape supply device and can orbit from a standby position to wrap the tape around the leaf paper. A leaf paper holding device is also provided to facilitate the tightening of the wrapped tape and holds the leaf paper to both sides of the tape in the direction of the width of the wrapped tape.

4 Claims, 21 Drawing Sheets

LEAF PAPER BUNDLING APPARATUS

BACKGROUND OF THE INVENTION

The present invention relates to a leaf paper bundling apparatus that wraps tape around the periphery of a stack of sheets of leaf paper of the same size and shape which cuts the tape with a cutter, and which adheres the ends of the tape together with a thermo-adhesion head to bundle leaf paper.

A bundling apparatus that stacks a required number of banknotes or other sheets of paper of the same size and shape, and bundles them with tape has been disclosed in for example, Japanese Patent Application Laid-Open No. 58312/1985. The bundling apparatus disclosed in this publication has a leaf paper insertion opening open at a front surface of a main apparatus unit, and leaf paper inserted to a bundling position from the opening is positioned confronting a circular rotating wheel. The rotating wheel is provided with a member (for example, a roller) for wrapping tape around the leaf paper that is to be bundled, i.e. the rotation of the rotating wheel moves the bundling tape around the periphery of the leaf paper and also applies a tension to the tape which is then cut by a cutting apparatus. The cut ends are then adhered to one another with an adhesion head.

However, with this conventional apparatus, a first problem is that the rotating wheel is provided at the bundling position to wrap the tape around the leaf paper and so it is not possible for the leaf paper to be inserted from the axial direction of the rotating wheel, that is, from the front of the apparatus. Thus the apparatus is not convenient to use, and the operability thereof is limited.

A second problem is that the leaf paper may not necessarily be positioned accurately at the bundling position when the leaf paper is inserted. Because the tape will not be accurately wrapped if the leaf paper moves while the tape is being wrapped, the leaf paper must be at the bundling position during bundling. the leaf paper can be held by a special holding mechanism prior to the bundling operation but this interferes with the operation of the mechanism that performs the bundling operation. The apparatus is thus rather complex and requires a large amount of installation space.

SUMMARY OF THE INVENTION

In the light of these problems, an object of the present invention is to provide a leaf paper bundling apparatus that enables leaf paper to be inserted to the bundling position from either the front or the top of the apparatus so as to be convenient to use, and which is compact.

In order to eliminate the problems associated with the conventional technology, the present invention includes a leaf paper insertion opening portion having a slit open to the top and front portions of the main apparatus unit and into which leaf paper to be bundled is inserted uprightly from the front or top of the main apparatus unit, a leaf paper regulation means which receives a lower edge of leaf paper which has been inserted in a downwards or forward direction through the main apparatus unit and a leading edge so as to position the leaf paper, a tape supply means which supplies tape to be wrapped around the periphery of the leaf paper, applies a tension to the tape so as to tighten the tape around the periphery of the leaf paper, a tape wrapping means which has an arm which can hold an end of tape fed from the tape supply means and which can orbit from a standby position to facilitate the wrapping of the tape around the leaf paper, and a leaf paper holding means provided so as to hold the leaf paper at both sides of the tape wrapped around the periphery of the leaf paper thereby allowing the tape to be tightened.

In a first embodiment of the present invention, the leaf paper is positioned by the regulating means irrespective of whether the leaf paper has been inserted from the front or the top of the main apparatus unit. Subsequently, when the leaf paper is detected at the bundling position, the tape winding means orbits to wrap tape around the periphery of the leaf paper and a holding means holds the leaf paper enabling the tape to be tightened by a tape tensioning means.

DESCRIPTION OF THE PREFERRED EMBODIMENTS

The following is a description of preferred embodiments of the present invention, with reference to the accompanying drawings.

Figure 1A:
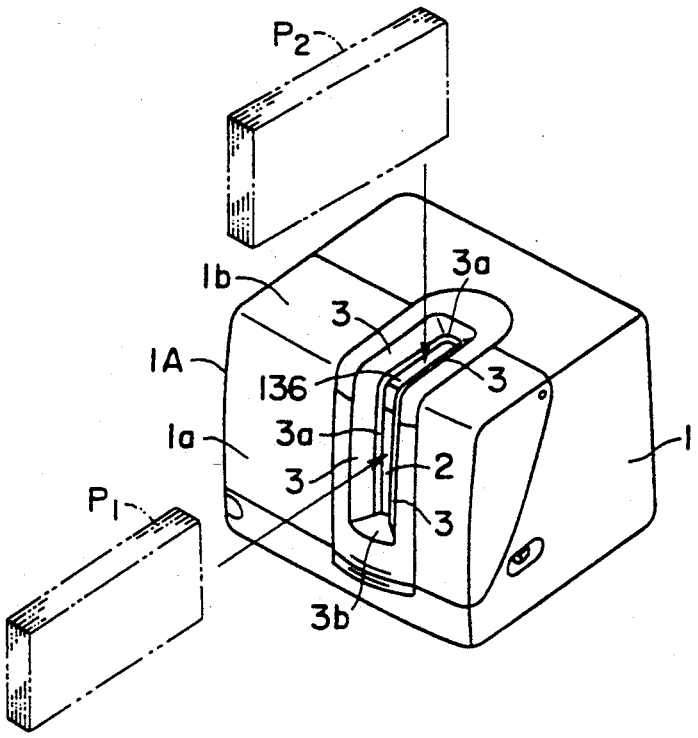
FIG. 1A is a perspective view of an embodiment of a leaf paper bundling apparatus according to the present invention.

FIG. 1A is a perspective view of a leaf paper bundling apparatus to which the present invention has been applied. In this figure, a main apparatus unit 1 having a box-like shape includes an upper front portion pivoted to a rear portion thereof so as to form a front cover 1A which is openable. A slit-shaped leaf paper insertion opening portion 2 extends from the front surface 1*a* to the upper surface 1*b* of the front cover 1A, and define an opening leading into unit 1. The opening has the sectional shape of an inverted letter L so that a number of sheets of leaf paper P (such as banknotes) that have been stacked can be inserted into the opening either uprightly and in the horizontal direction from the front of the main apparatus unit 1 as shown by $P_1$, or uprightly and in the vertical direction from the top of the main apparatus unit 1 as shown by $P_2$.

Both sides of the leaf paper insertion opening portion 2 are formed by guide edges 3, 3 that widen outward so that the leaf paper P can be smoothly inserted. Contiguous with these guide edges 3, 3, are opposing flat guide surfaces 3*a*, 3*a*. A regulating surface 3*b* forms the lower end of the leaf paper insertion opening portion 2.

Figure 1B:
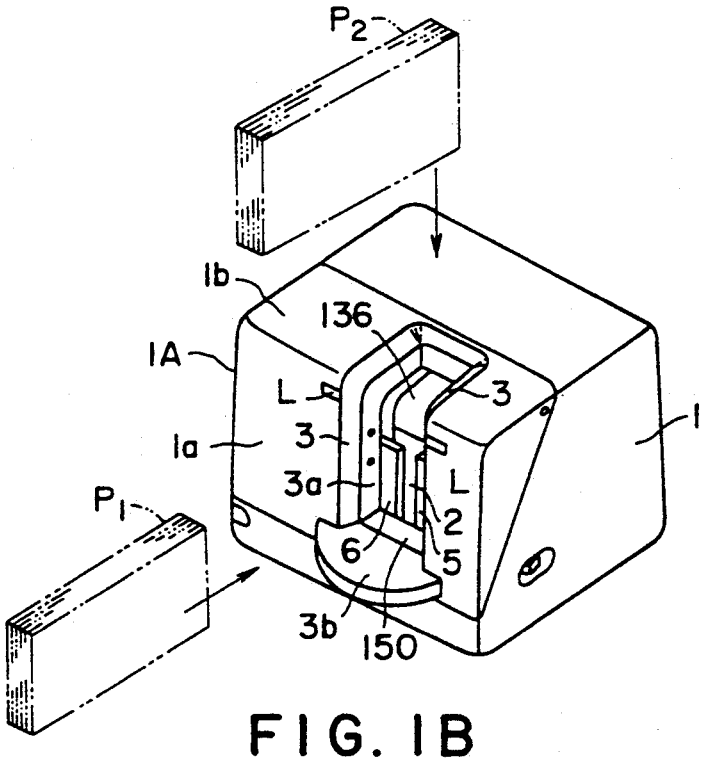
FIG. 1B is perspective view of another embodiment.

FIG. 1B shows a regulating surface 3*b* that extends froward from the front surface 1*a* of the front cover 1A of the main apparatus unit 1. The regulating surface 3*b* forms one portion of a regulating means that positions the leaf paper P at the bundling position. A leaf paper insertion detection means (described later) detects that the leaf paper P has been positioned at the bundling position.

To both sides of an upper part of the leaf paper insertion opening portion 2 are provided display portions L, L. These display portions L, L display the following operating statuses, for example.

Steady green lamp: Indicates a standby status in which leaf paper insertion and bundling are possible.

Slowly blinking green lamp: Indicates that the bundling mechanism is operating.

Quickly blinking green lamp: Indicates a completion of bundling and the presence of leaf paper inside the unit 1. When bundled leaf paper is removed, the blinking speed of the lamp first changes from fast to slow, the bundling mechanism returns to a set position, and then the lamp changes to steady green.

Steady red lamp: Indicates an error or an operation failure.

Alternating red and green blinking lamps: Indicates that little paper tape remains.

Leaf paper holding means 4 are arranged on both sides of the path along which the leaf paper P is inserted into the unit 1 from the leaf paper insertion opening portion 2, and hold from both the left and right sides the leaf paper P that has been inserted from the leaf paper insertion opening portion 2 to the bundling position. One example of the holding means 4 is shown in FIGS. 2 through 6.

Figure 3:
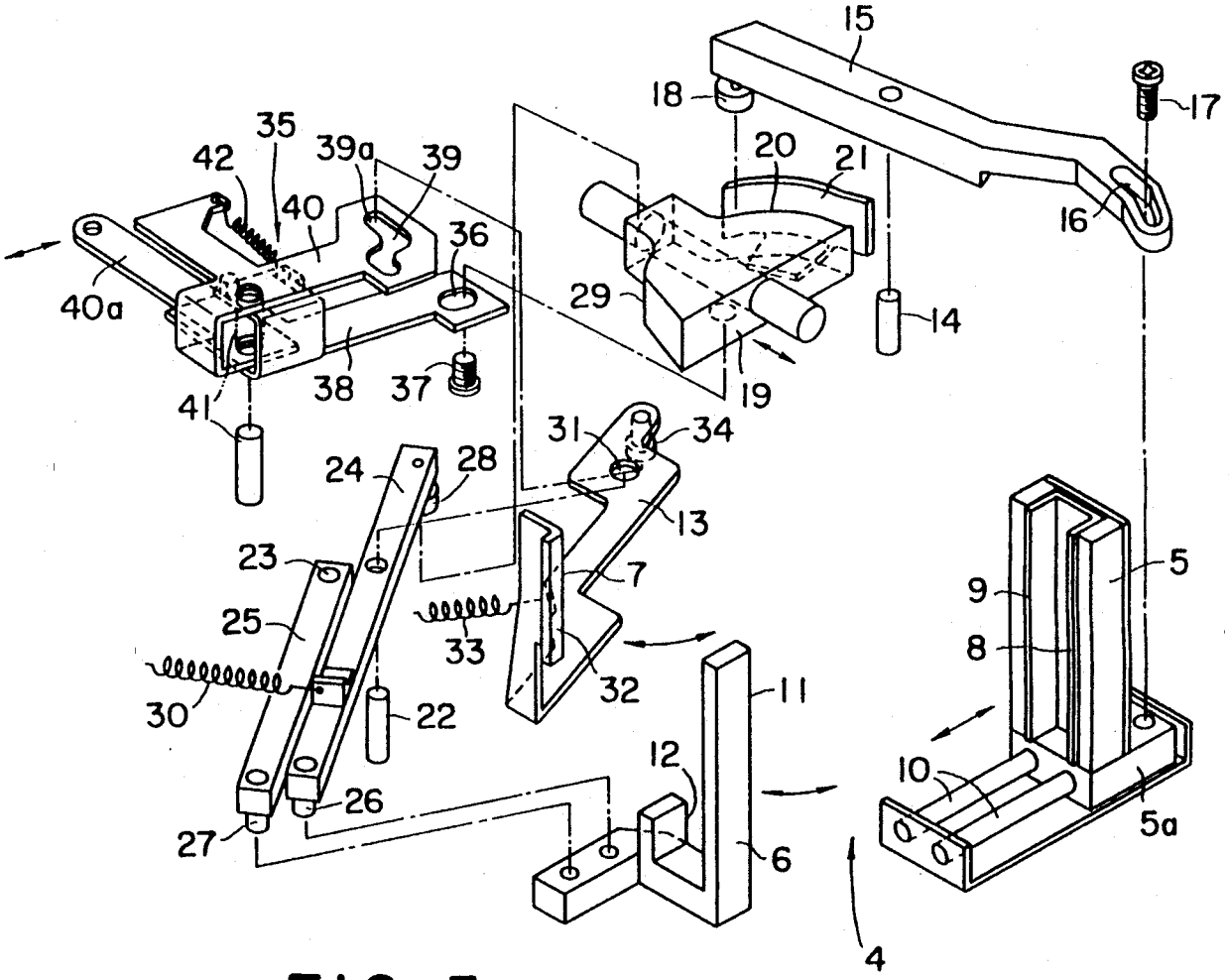
FIG. 3 is an exploded view of the leaf paper holding means.
Figure 4:
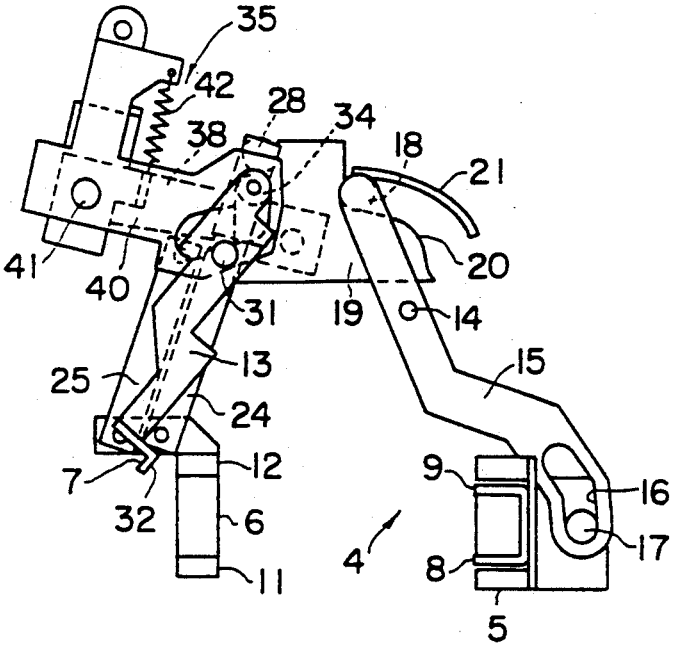
FIG. 4 is a plane view of the holding means prior to operation.
Figure 5:
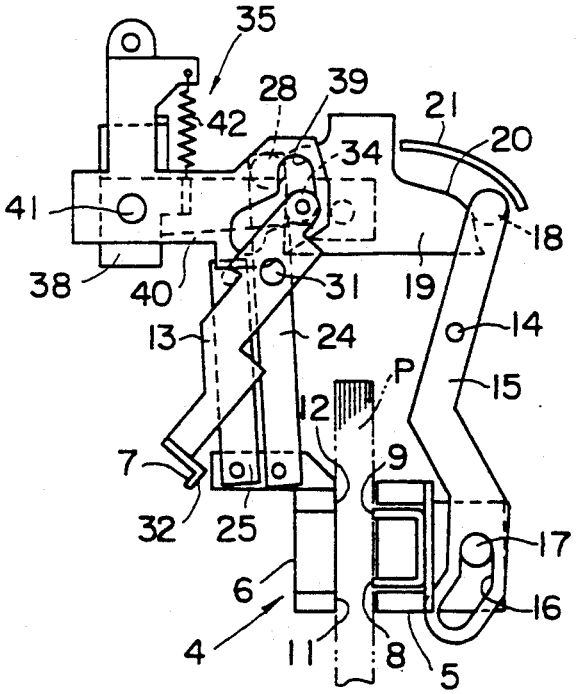
FIG. 5 is a plane view of the holding means showing leaf paper held by first and second hold members of the holding means.
Figure 6:
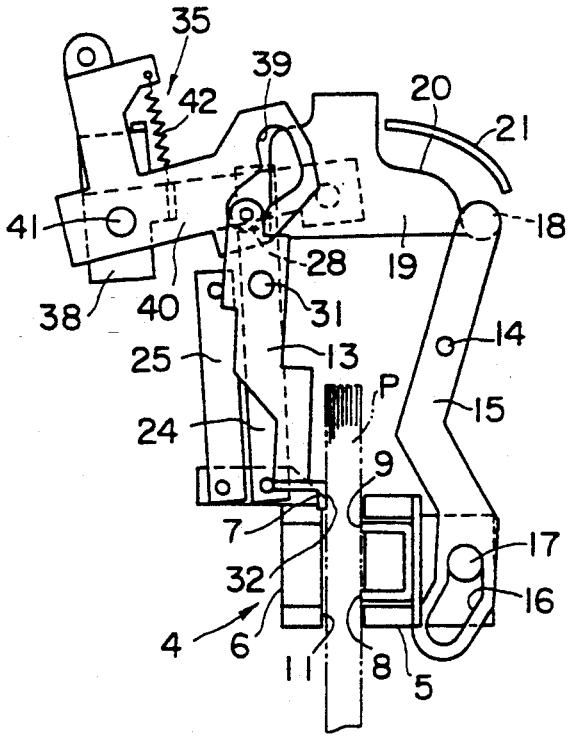
FIG. 6 is a plane view of the holding means showing leaf paper held by the first, second and third hold members of the holding means.

More specifically, as shown by the broken-away drawing of FIG. 3 and the plane views of FIGS. 4 through 6, a first hold member 5 is positioned at one side of the leaf paper P that is inserted to the bundling position, a second hold member 6 and a third holding member 7 are positioned on the other side.

The first hold member 5 has a length greater than the shorter dimension of the stack of leaf papers P that has been inserted to the bundling position. That is, two holding surfaces 8, 9 that are longer than the width of the leaf paper P are provided with a gap between them through which the tape T can pass. A base portion 5*a* of the first hold member 5 is supported so as to be freely moveable along guide rails 10, 10 in the thickness direction of the leaf paper P.

The second hold member 6 has a holding surface 11 that is substantially the same height as the holding surface 8 of the first hold member 5, that is, a holding surface 11 that is longer than the width of the stack of the leaf paper P, and a holding surface 12 that has a low height and that corresponds to a lower portion of the holding surface 9 of the first hold member 5. The third holding member 7 extends from one end of a lever 13 at a level above the holding surface 12 of the second hold member 6.

When the leaf paper P is held by the first hold member 5 and the second hold member 6, it is held across its full width so that the ends of the leaf paper will not be bent when the tape is tightened in the course of tape wrapping.

In FIG. 3, the operation mechanisms of each of the holding members are shown as a linkage. More specifically, the first hold member 5 is supported at the base portion 5*a* thereof by an arm 15 so as to be freely rotatable in a horizontal plane. The arm 15 is pivotable about the axis of a shaft 14 fixed in the main apparatus unit 1. A pin 17 extends through an elongate hold 16 in one end of the arm 15 to link the arm 15 to the base portion 5*a* of the first hold member. A roller 18 pivoted to the other (base) end of the arm 15 contacts a cam surface 20 on the right side of a cam member 19. The cam member 19 is supported for movement towards the front and back of the main apparatus unit 1 (as shown by the arrow in FIG. 3). This roller 18 is constrained to move along the cam surface 20 by a guide member 21 that has a similar shape to the cam surface 20.

The second hold member 6 is linked by pins 26, 27 to the distal end of two parallel links 24, 25 that are freely rotatable in a horizontal plane about the axis of shafts 22, 23 fixed in position in the main apparatus unit 1. A spring 30 urges a roller 28 at the base end of the link 24 into contact with a cam surface 29 on the left side of the cam member 19. The shaft 22 of link 24 extends into a shaft hole 31 in the middle portion of the lever 13 that supports the third holding member 7. When the lever 13 pivots about shaft 22, the holding surface 32 of the third holding member 7 supports the leaf paper P along with upper portion of the inner holding surface 9 of the first hold member 5. Numeral 33 designates a spring for returning the lever 13 to its inoperative position.

The base end of the lever 13 supports a roller 34. This roller 34 extends into an elongate hole 39 of a relay mechanism 35 to be described later. This relay mechanism 35 has a drive member 40 that is supported for rocking movement in the direction shown by the arrow, and has an elongate hold 36 in one end of a member 38 of the relay mechanism 35. A pin 37 extends from the middle of a lower surface of a cam member 19 into hole 36 to link relay mechanism 35 to cam 19. The member 38 has the shape of a reversed letter C when viewed from the left side of FIG. 3 and the shape of a letter L when viewed in plane. The end of the drive member 40 which has the elongate hold 39 serves as a crank, and the other end thereof has a drive portion 40*a* that is rocked in the direction shown by the arrow by a drive mechanism comprising a cam not shown in the figure. The middle portion of the drive member 40 has the shape of a reversed letter C when seen from the back in FIG. 3. The middle portions of these members 38, 40 having the shapes of reversed letters C engage one another and are pivotably supported in the main apparatus unit 1 by a common pivot shaft 41. The roller 34 of the lever 13 extends into the elongate hole 39 that serves as a crank.

When a rocker mechanism (comprising the cam not shown) connected to the drive portion 40*a* rocks member 40 about the shaft 41 in the counterclockwise direction in FIG. 3, the member 38 that is joined to the member 40 by a tension spring 42, also rocks in the same direction, and the cam member 19 that is linked to the member 38 by the pin 37 moves back and forth. Along with this, because the elongate hole 39 serves as a crank, the lever 13 is rotated in the counterclockwise direction in FIG. 3 about shaft 22. Via the roller 34, the third holding member 7 is delayed relative to the first hold member 5 and the second hold member 6 from advancing to the leaf paper hold position. At this time, even if the first hold member 5 and the second hold member 6 hold a thick stack of leaf paper, the cam member 19 stops midway of its retreat, the tension spring 42 that links the member 38 and the drive portion 40 elongates and only the drive member 40 continues to rotate. Thus, the third holding member 7 advances to the leaf paper bundling position via the lever 13. (See FIG. 6.)

The left and right cam surfaces 20, 29 of the cam member 19 have inclined portions that are wider apart from one another on the side of the cam 19 closest to leaf paper bundling position. When the cam member 19 moves back, the rollers 18, 28 of the arm 15 and link 24 are pressed to the left and right in FIG. 3 and so the first hold member 5 and the second hold member 6 approach each other.

Figure 7:
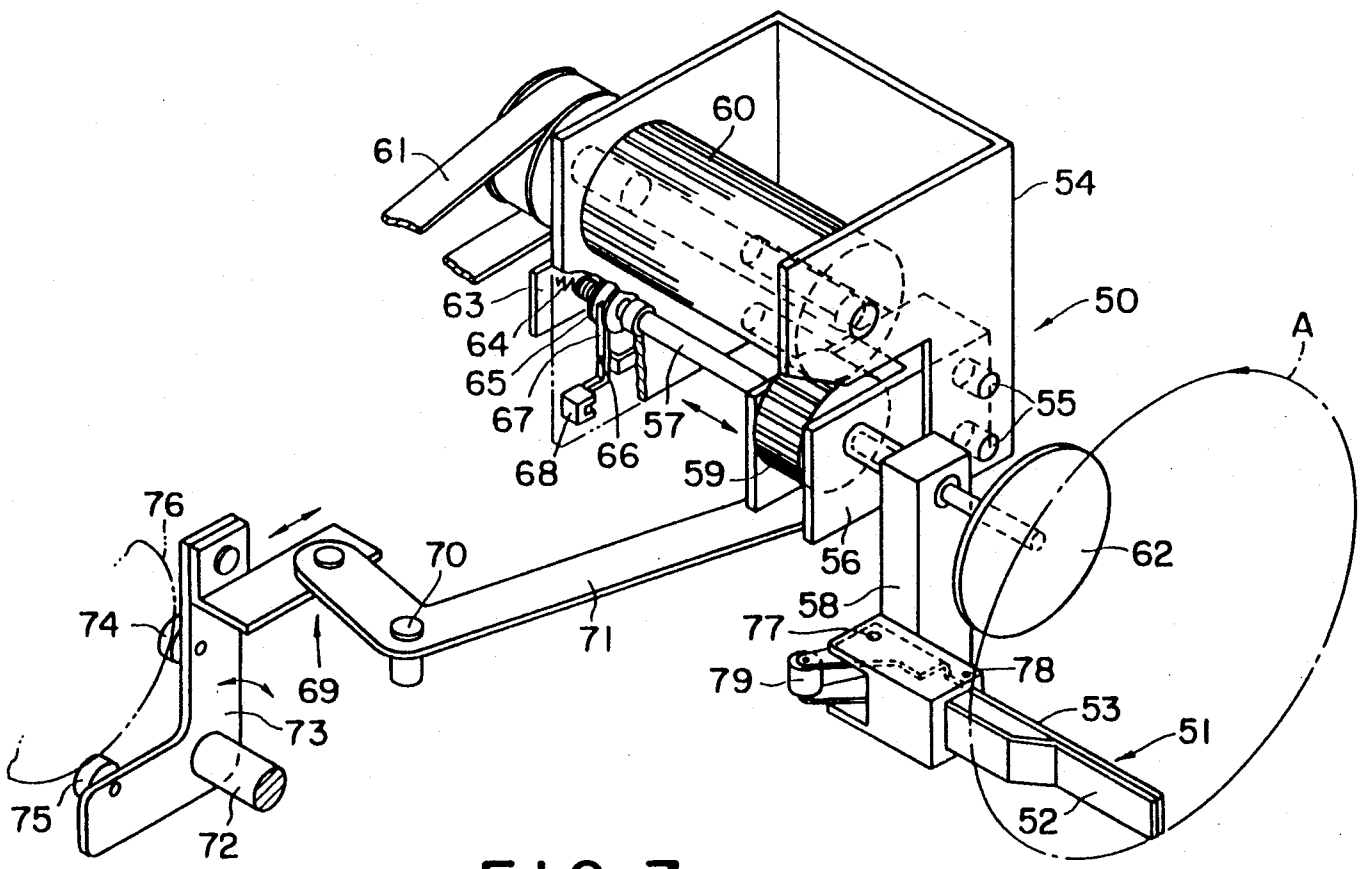
FIG. 7 is a perspective view of the tape wrapping means.
Figure 8:
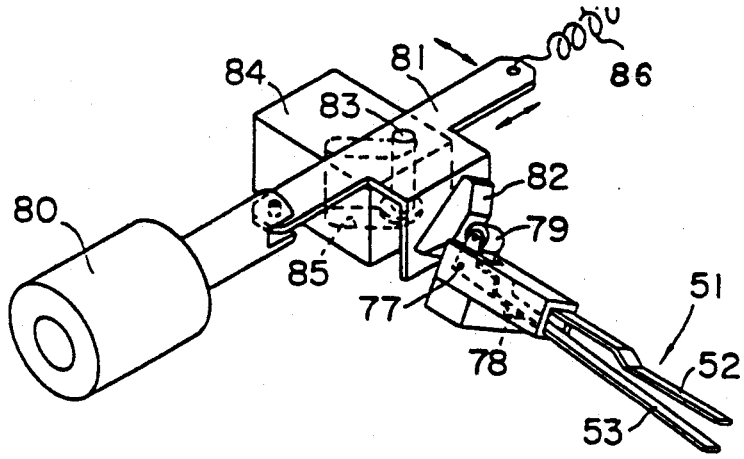
FIG. 8 is a perspective view of the mechanism for opening and closing the arm of the tape wrapping means of FIG. 7.

The tape wrapping means 50 is shown in FIG. 7. FIG. 8 shows a mechanism for opening and closing an arm 51 of the tape wrapping means 50. The arm 51 includes a moving arm 53 and a fixed arm 52 that hold the leading end of the tape T. The arm 51 can be moved around the periphery of the leaf paper P, at the bundling position, following a circular path shown by the letter A in the figure.

The fixed arm 52 extends parallel to the axis of a shaft 57. The distal end of shaft 57 supports a revolving arm 58 that rotates about the axis of the shaft 57. A portion of shaft 57 is in turn supported by a machine frame 56. The shaft 57 is movable in its axial direction because machine frame 56 is supported by and can slide in the same direction, along guide rods 55, 55 of a machine frame 54. On the portion of shaft 57 supported by the movable frame 56 is fixed a gear 59 having short teeth. This gear 59 always meshes with a gear 60 having long teeth and which is mounted to the machine frame 54. This gear 60 is rotated by a motor (not shown) via a belt 61.

A detection plate 62 is fixed to the distal end of the shaft 57, and constitutes one element of the leaf paper insertion detection means that detects the leaf paper P at the bundling position. Between the other end of the shaft 57 and a member 63 fixed to the machine frame 54 there is a compression spring 64 that urges the shaft 57 toward the front of the unit 1. To this end of this shaft 57 is fixed a pulley 65. The groove of this pulley 65 receives one end of a rocking lever 67 that rocks about a shaft 66, and the other end of this rocking lever 67 is linked to a sensor 68. When the rocking lever 67 is rocked by movement of the shaft to the inside, leaf paper trailing end detection signals are obtained via the sensor 68.

A mechanism 69 for moving the moving frame 56 includes a L-shaped lever 71 that has a leg linked to the moving frame 56 and pivotably supported by a shaft 70 fixed in position in the main apparatus unit 1, a lever 73 that has a leg linked to one end of lever 71 and which is pivotably supported by a shaft 72 fixed in position in the main apparatus unit and cam followers 74, 75 mounted to the lever 73 so that the lever 73 can be rocked to push and pull lever 71.

The moving arm 53 is supported for movement about the base portion thereof so at to open and close scissorwise with respect to the fixed arm 52. That is, the moving arm 53 is supported so as to be rotable about a shaft 77 fixed to the revolving arm 58, and is urged by a spring 78, extending between a portion of arm 53 proximate the base end thereof and the revolving arm 58, in the closed direction. In addition, when a cam follower 79 strikes a cam 82 on the side of an element 81 that is reciprocated by a solenoid 80 as shown in FIG. 8, the moving arm 53 is separated from the fixed arm 52. Element 81 has a pin 83 fixed to it. The pin 83 extends in an elongate guide hole 85 of a guide member 84. The guide hole 85 is angled relative to the axis of the solenoid 80 so that the cam 82 will be pulled in when the moving member 81 is drawn in by the excited solenoid 80. When the excitation of solenoid 80 ceases, the cam 82 is pulled by the spring 86 and advances into camming engagement with the cam follower 79.

Figure 2:
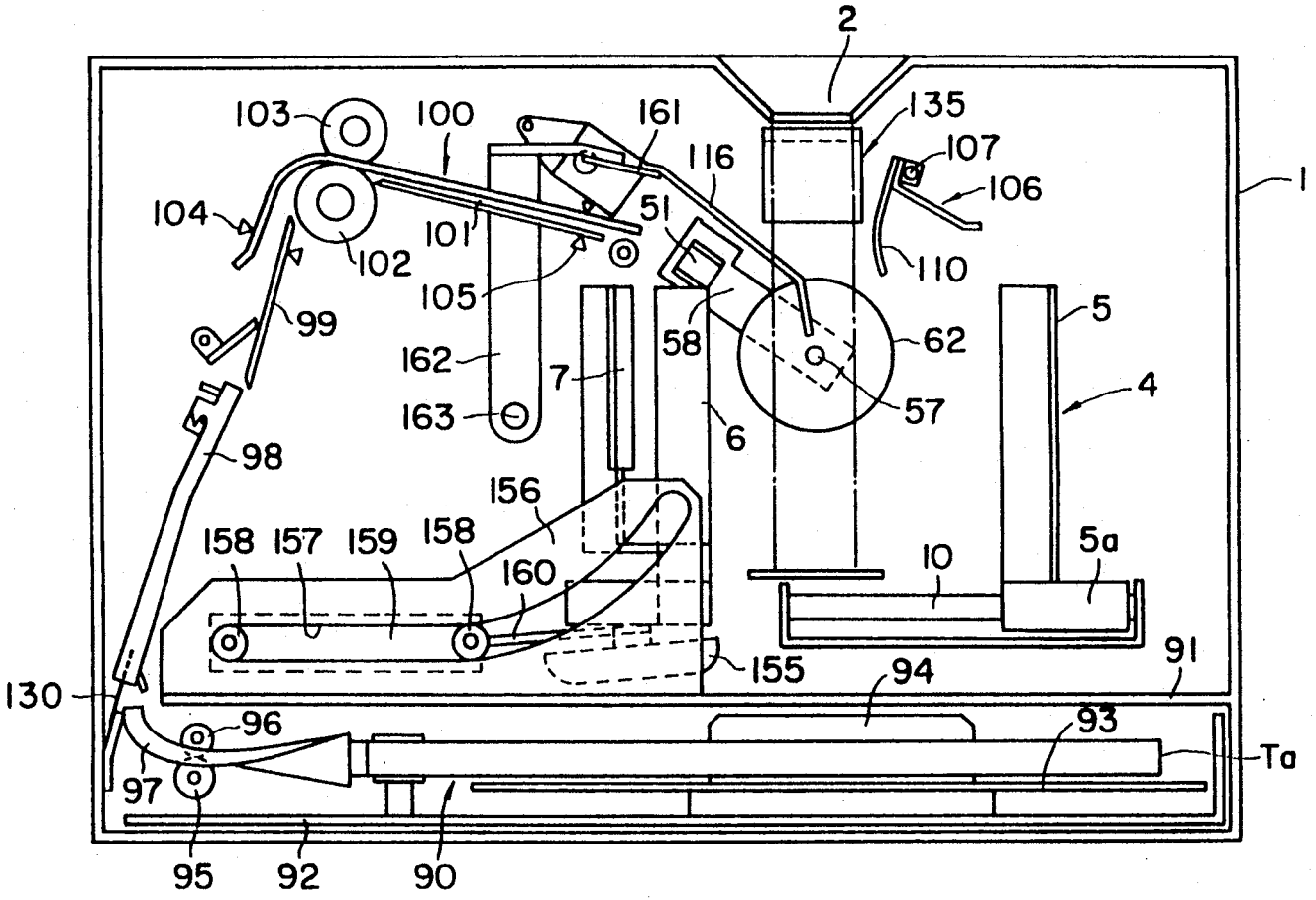
FIG. 2 is a front view of the leaf paper bundling apparatus of FIG. 1, with the cover removed.

A tape supply portion 90 has a tape loading plate 93 supported on a draw plate 92. A tape reel Ta is supported on the loading plate 93 so that tape T is freely drawable from beneath a base plate 91 on which the leaf paper holding means 4 of the main apparatus unit 1 is supported, as shown in FIG. 2. More specifically, the tape T is drawn from the tape reel Ta that is mounted with its center hole received by a cylindrical member 94 disposed at the center of the tape loading plate 93. A drive roller 95, a guide roller 96, a tape lead guide 97 and tapes guides 98, 99, lead the tape T to a tape supply means 100. This tape supply means 100 tensions the tape T and has a flat tape guide 101, and top and bottom rollers 102, 103 that feed the tape T to the tape guide 101. One of the rollers 102 is rotatably driven by a pulse motor (not shown) that feeds the tape T by the necessary amount, and rotates in reverse at required intervals to tension the tape T. Downstream of the rollers 102, 103 and proximate the exit end of the tape guide 101 are provided sensors 104, 105 for detecting the tape T. The forward and reverse rotation of the roller 102 is controlled by the pulse motor based on signals from the sensors 104, 105.

Figure 15:
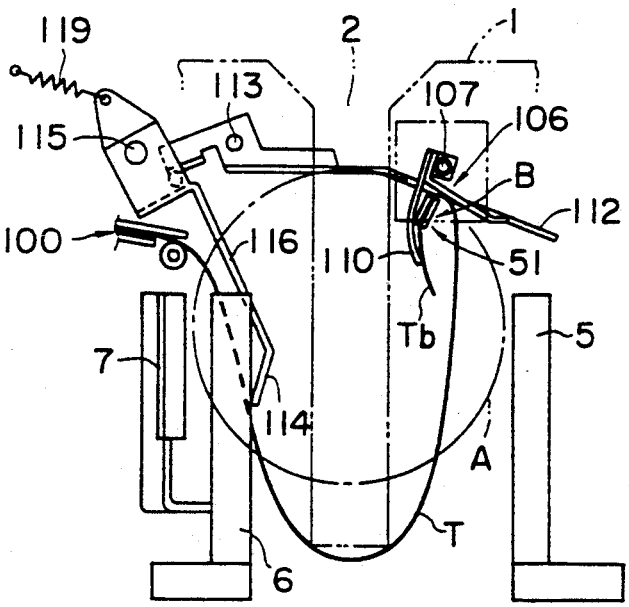
FIG. 15 is a similar view showing the arm of the tape winding means at the standby position.

A tape straightening plate 106 is provided in the vicinity of the arm 51 when the arm 51 is at the standby position (the position B in FIG. 15). This tape straightening plate 106 is substantially in the shape of a letter L, and the corner portion thereof is pivotably supported by a shaft 107. Shaft 107 is so supported by a shaft receiver 108 (FIG. 9) that it can rotate. A return spring 109 mounted between the shaft receiver 108 and the tape straightening plate 106 urges the tape straightening plate 106 to a set position. This set position of the tape straightening plate 106 is a position that is spaced slightly away from the path along which the leaf paper P is inserted so that the straightening arm 110 of the tape straightening plate 106 will not interfere with the leaf paper P that is being inserted to the bundling position (See FIG. 2). The distal end of the tape T that is held by the arm 51 is constrained by the straightening arm 110 so that it does not project into the insertion path of the leaf paper P (FIG. 15). Then, when the arm 51 is moved along path A, the straightening arm 110 is struck by the arm 51 (FIG. 17), and the tape straightening plate 106 rotates against the force of the spring 109 to allow the passage of the arm 51. After the arm 51 has passed by the plate 106, the action of the return spring returns it to the set position (FIG. 18).

Figure 9:
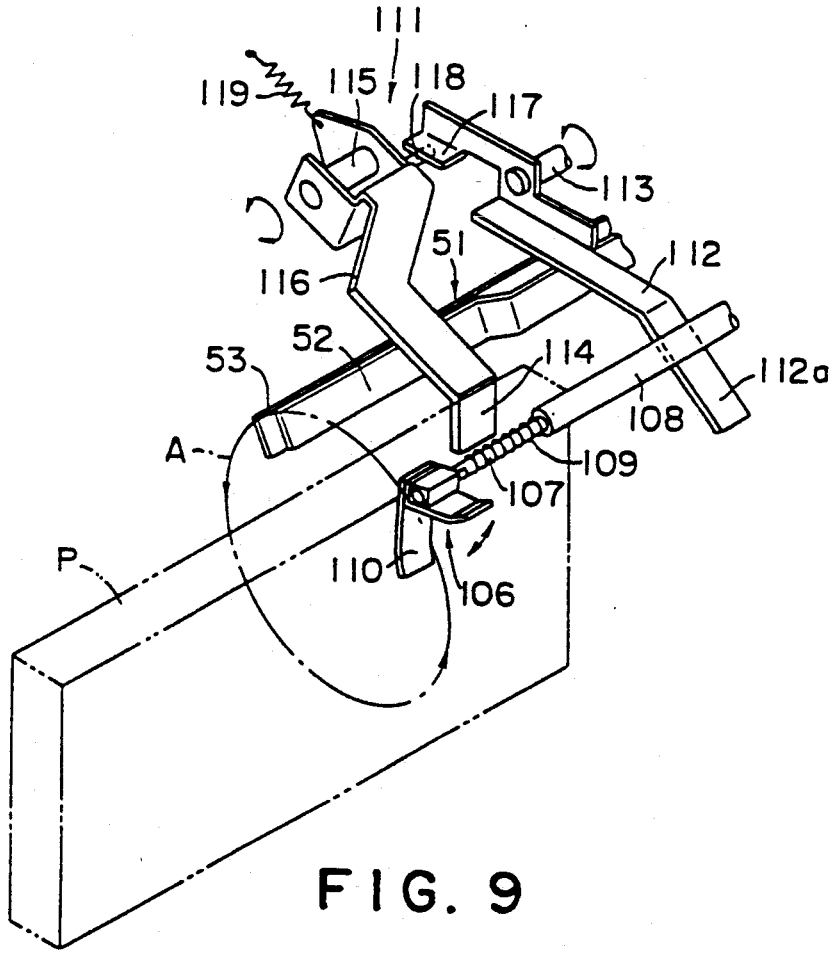
FIG. 9 is a detailed perspective view of the leaf paper pressing mechanism.

Slightly to the inside of the tape straightening plate 106 is a leaf paper pressing mechanism 111 pivoted to prevent the leaf paper inner end of the leaf paper P from slipping from the bundling position. As shown in FIG. 9, this leaf paper pressing mechanism 111 includes a lever 112 having a distal end portion 112*a* located in the path of the arm 51 of the tape wrapping means 50. The middle portion of the operating lever 112 is pivotably supported in the main apparatus unit 1 by a shaft 113. The leaf paper processing mechanism 111 also includes a leaf paper pressing lever 116 that is pivotably supported in the main apparatus unit 1 by a shaft 115. A pressing portion 114 at the distal end of lever 116 can contact an upper end portion of the stack of leaf paper P located at the bundling position. An engaging portion 117 of the rear end of the operating lever 112 engages with a protruding portion 118 of the pressing lever 116. A spring 119 that is stretched between the pressing lever 116 and a fixed portion of the main apparatus unit 1 maintains the protruding portion 118 in contact with the engaging portion 117. When the distal end portion 112*a* of lever 112 is raised by the arm 51, the pressing portion 114 of the pressing lever 116 thus rotates in a direction which will cause it to separate from the paper surface of the leaf paper P.

Figure 10:
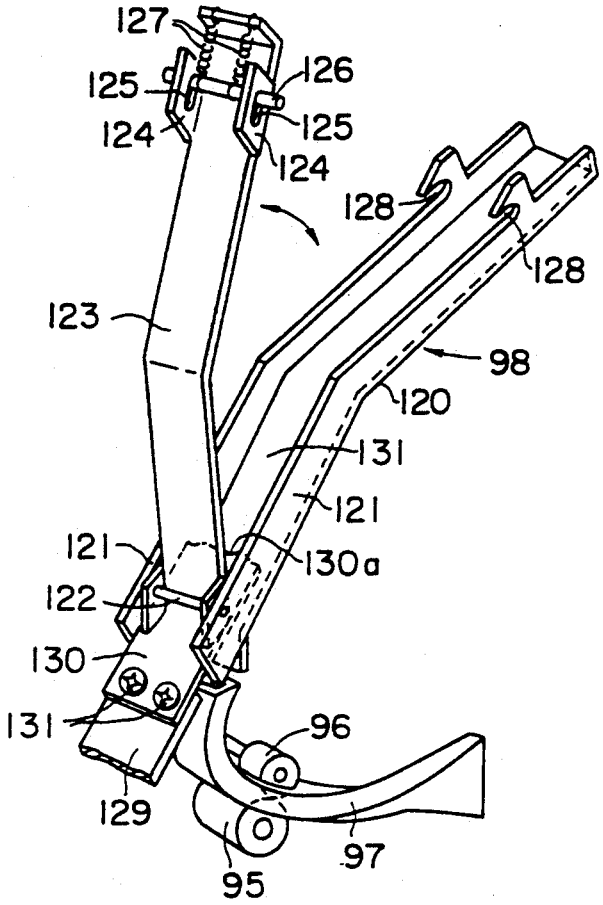
FIG. 10 is a perspective view of the tape guide showing the lid of the tape guide in an open state.

The tape guide 98 that leads the tape T, that is fed from the tape supply portion 90, to the tape supply means 100 is provided with a tape path member 120 that has a U-shaped section as shown in FIG. 10, and a lid member 123 that is pivotably supported by a shaft 122 extending between side wall portions 121, 121 of the lower portion of the tape path member 120. The lid member 123 is thus freely openably and closable over the upper surface 131 of the tape path member 120. The free end of this lid member 123 includes upright shaft supports 124, 124 extending upright at the sides of the lid member 123. A pin 126 is freely received in holes 125, 125 in the shaft supports 124, 124 so that it can move in the longitudinal direction of the lid member 123. This pin 126 is urged toward the distal end of the lid member 123 by springs 127, 127. The sides of the tape path member 120 are provided with hook-shaped engaging portions that engage the distal ends of the pin 126, and the engagement of the pin 126 with the engagement portions 128, 128 holds the lid member 123 in a closed state.

Screws 131, 131 or the like fix a base portion of a cutter member 130 comprising a flexible material to a fixed member 129 at a position in which the cutter member 130 will not obstruct the advancing of the tape T from the tape advancing end of the tape path 10. Specifically, the free end of this cutter member 130 enters into the tape path member 120 but there is always a gap between the cutter member 130 and the upper surface 131 of the tape path member 120 so that there is no obstruction to the passage of the tape T.

Figure 11:
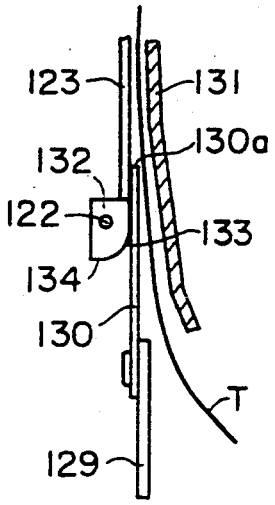
FIG. 11 is a partial sectional view of the tape guide showing the state wherein the tape passes there along.
Figure 12:
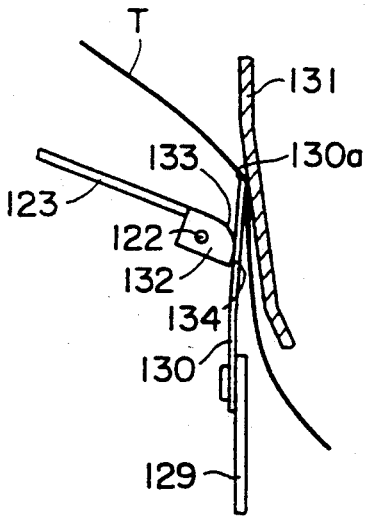
FIG. 12 is a partial sectional view of the tape guide showing the state wherein the tape is cut.

The base end of the lid member 123 is provided with a cam portion 132 (FIGS. 11 and 12) that contacts the back surface of the cutter member 130. This cam portion 132 has a cam surface 134 of large diameter and a cam surface 133 of small diameter with respect to the pivot shaft 122 of the lid member 123. The small-diameter cam surface 133 is placed along the cutter member 130 when the lid member 123 is closed. When the lid member 123 is opened, the large-diameter cam surface comes into contact with the cutter member 130 and gradually presses the cutter member 130 towards the upper surface 131 where a blade portion 130*a* at the distal end of the cutter member 130 is pressed into contact with the tape T extending along the upper surface 131. Accordingly, when the lid member 123 is opened, the pulling and tensioning of the tape T from downstream of the tape path member 120 causes the tape T to be cut by the blade portion 130*a* of the cutter member 130, and the jamming of the tape is promptly eliminated.

Figure 13:
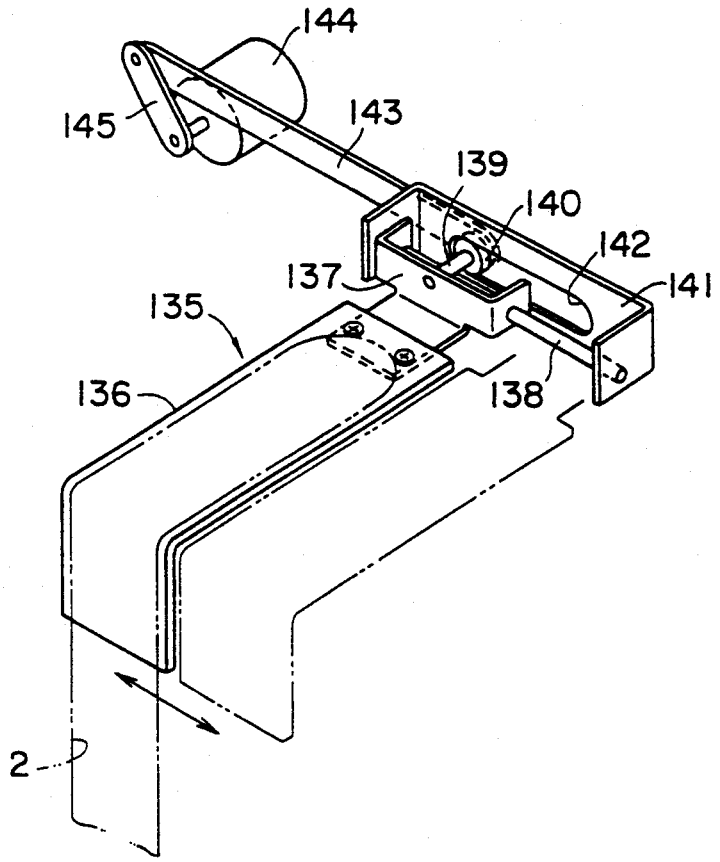
FIG. 13 is a perspective view of the shutter mechanism of the leaf paper insertion opening portion of the main apparatus unit.

Inside that portion of the leaf paper insertion opening portion 2 of the main apparatus unit 1 that opens to the upper surface 1*b* is provided a shutter mechanism 135 that opens the opening portion 2 during a bundling operation. As seen in FIG. 13, shutter mechanism 135 has an L-shaped shutter plate 136 that is slightly wider than the width of the opening portion 2, a shaft support 137 that supports the base portion of the shutter plate 136, a shaft 138 that extends to one side of the leaf paper insertion opening portion 2 and that supports support 137 so as to be freely slidable therealong, a roller 140 supported on a shaft 139 that is fixed to the rear of shaft support 137, a frame 141 having a guide hole 142 that extends therein in the horizontal direction and that supports the shaft 138 and the roller 140 within hole 142. The shutter plate 136 is thus supported so as to be freely movable in the horizontal direction along the two supports formed by the roller 140 and the shaft 138. The end portion of the shaft 139 of the roller 140 is linked to one end of a lever 143, and the other end of this lever 143 is linked to an arm 145 of a rotary solenoid 144. Therefore, the rotary solenoid moves the shutter plate 136 via the lever 143 between the closed position shown by the solid line in FIG. 13 and the open position shown by the dotted line in FIG. 13.

Figure 22:
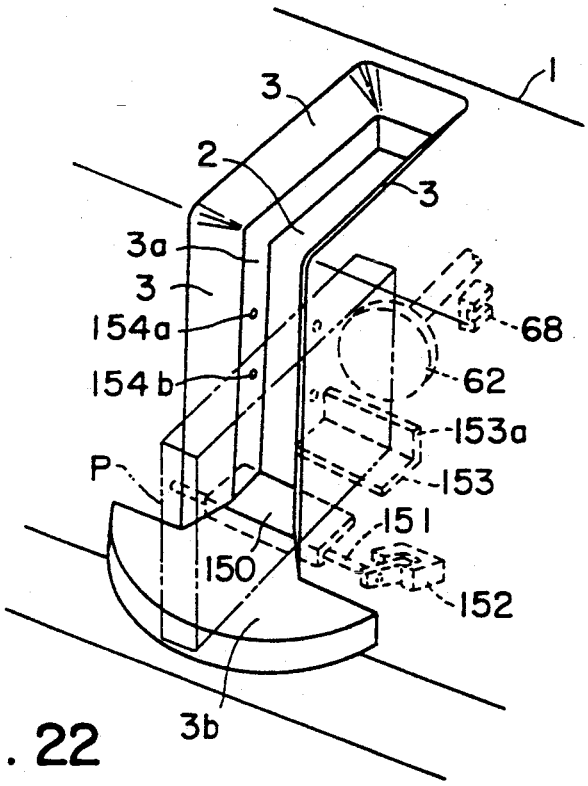
FIG. 22 is a perspective view of the leaf paper detection means and the regulating means.
Figure 23:
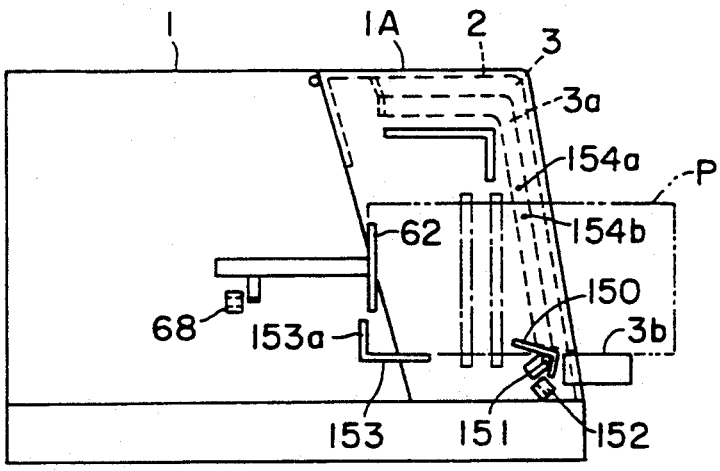
FIG. 23 is a side elevation view of the leaf paper detection means and the regulating means.

As shown in FIG. 22 and FIG. 23, to the inside of the regulating surface 3*b* of the leaf paper insertion opening portion 2 of the main apparatus unit i, there is an operating arm 150 supported by a shaft 151. The operating arm 150 will be pressed by the lower edge of the stack of leaf paper P when it is inserted from either the front or top of unit 1 through the leaf paper insertion opening portion 2. Normally, a spring (not shown) positions the distal end of arm 150 above the regulating surface 3b so that when it is pressed by the lower edge of the stack of leaf paper P, it becomes horizontal, lying in substantially the same plane as the regulating surface 3b, and actuates the sensor 152. This sensor 152 also constitutes a leaf paper insertion detection means by serving as a leaf paper lower edge detection sensor.

In addition, a positioning plate 153 is located opposite the front surface 1a of the main apparatus unit 1 so as to receive the stack of leaf paper inserted from the top or from the front of unit 1. This positioning plate 153 has the shape of a letter L and positions the lower corner portion of the stack of leaf paper P. An upright portion 153a of positioning plate 153 is contacted by the leaf paper P when the detection plate 62 is pressed by the leaf paper P to operate the sensor 68.

At the guide surfaces 3a, 3a of the leaf papers insertion opening portions 2 are provided leaf paper insertion detection means comprising sensors 154a, 154b of optical elements that detect the upper edge of the leaf paper. That is, when either of the sensors comprising the optical elements are blocked by the leaf paper, the sensors 154a, 154b detect the upper edge of the leaf paper. Numeral 155 in FIG. 2 designates an adhesion head. The head 155 is supported via an arm 160 on the distal end of a freely movable moving platform 159 supporting rollers 158, 158. The rollers 158, 158 are received in elongate holes 157 extending in an arc from the horizontal direction in opposing guide rail portions 156 fixed in the main apparatus unit 1. Thus, head 155 rises along with the tape T that is wrapped around the leaf paper P. One end of the cut tape T is rubbed from a bottom to top portion thereof by head 155 and is thermally adhered to the other end of the tape T. The head 155 has a built-in heater of a known type.

Details of the cutter 161 are not shown in the figure but it is oriented in a direction perpendicular to the distal end of the arm 162. Arm 162 rotates around the axis of a shaft 163 so that the tape T is cut at a required position. The following is a description of the operation of this embodiment, with reference to the Figures.

Figure 14:
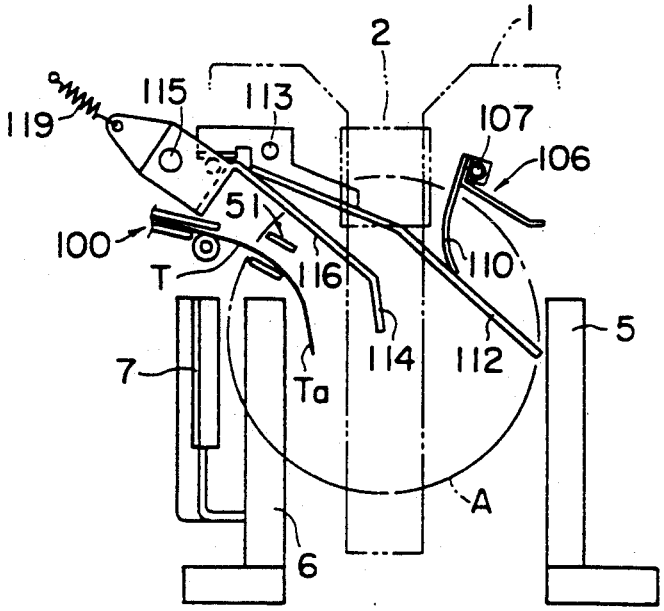
FIG. 14 is a front elevation view of a main operating portion of the apparatus showing the relationship between the various parts prior to the bundling operation.

The draw plate 92 of the tape supply portion 90 shown in FIG. 2 is drawn out and the tape reel Tb is placed on the tape loading plate 93. The tape T is drawn from the tape reel Tb between the drive roller 95 and the guide roller 96. The draw plate 92 is then pressed back in. When this pressing is detected by a sensor (not shown), and the roller 102 is driven, the tape T is fed. Then, after the sensor 105 detects the tape T, it feeds tape for a required number of pulses so that it protrudes from the distal end of the tape guide 101. At this time, the moving arm 53 of the tape winding means 50 is opened by the cam 82 of the moving member 81 at a position adjacent the distal end of the tape guide 101 and tape trails from between both arms (FIG. 14).

After this, the solenoid 80 of the tape winding means 50 is excited, the moving member 81 is retracted and the cam 82 is moved out of engagement with roller 79 so that the moving arm 53 is closed by the spring 79, whereby the tape T is held between the fixed arm 52 and the moving arm 53. Then the gear 60 is driven and the engaging gear 59 rotates. The revolving arm 58 is revolved to move the arm 51 to the standby position B in FIG. 15 while holding the roller 102 places the tape T in tape T. At this time, the feed of the tape T by a status in which the leaf paper is inserted.

The end portion Tb of the tape T is forced downwards by the straightening arm 110 of the tape straightening plate 106 so as not to block the insertion of the leaf paper P.

At this time, the relay mechanism 35 and the cam member 19 are at the positions shown in FIG. 4 in which the rollers 18, 28 of the link 24 and the arm 15 are at the inner ends of the cam surfaces 20, 29 and the first hold member 5, second hold member 6 and third holding member 7 are all in retracted positions. In addition, the shutter plate 136 of the shutter mechanism 135 of the leaf paper insertion opening portion 2 is in closed during a preparation stage, and opens when the leaf paper has been inserted to a standby position and the receiving preparations are completed.

In addition, when the arm 51 is moved to the standby position, the arm 51 presses the distal end portion 112a of the operating lever 112 upwards. Due to the engagement of the operating lever 112 and the protrusion portion 118 of the leaf paper pressing lever 116, the leaf paper pressing lever 116 is rocked in the clockwise direction of FIG. 15 to the side of the leaf paper insertion opening portion 2. Then, the stack of leaf paper is inserted into the main apparatus unit 1 through either the front (the $P_1$ direction) or the top (the $P_2$ direction thereof) via the leaf paper insertion opening portion 2. The front edge of the leaf paper presses the leaf paper detection plate 62 so that the shaft 57 is moved inwards to rock the rocker lever 67 and actuate the sensor 68. In addition, the lower edge of the stack of leaf paper P rocks the operating arm 150 and results in the actuation of sensor 152. The upper edge of stack of the leaf paper P is detected by the sensors 154a, 154b (by the sensor 154a being in a light receiving state, and the sensor 154b being in a light blocked state). The status of these sensors 68, 152, 154a, 154b indicates whether the leaf paper P has been inserted to the bundling position and issue detection signals automatically starting the bundling operation.

The command for automatically starting the bundling operation closes the shutter plate 136 of the shutter mechanism 135. Then, when the rocker mechanism (not shown) rocks the relay mechanism 35, the cam member 19 moves to the inside and the rollers 18, 28 of the link 24 and the arm 15 are moved apart by the left and right cam surfaces 20, 29.

Figure 16:
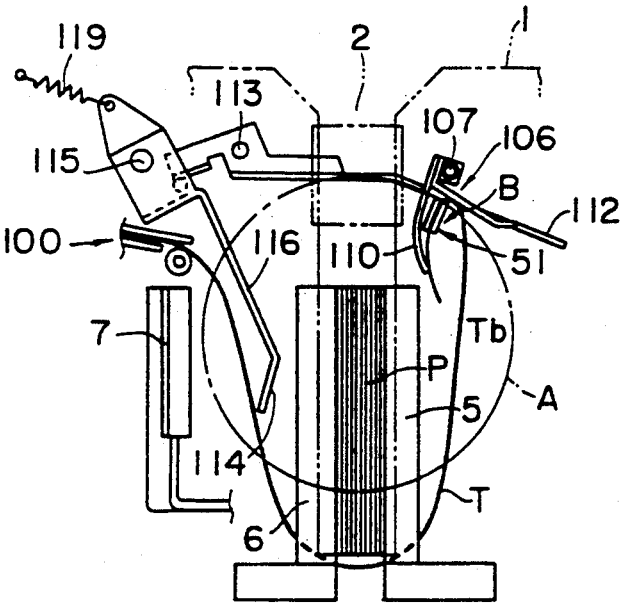
FIG. 16 is a similar view showing the leaf paper held by the first and second hold members.

The movement of the cam member 19 to the inside moves both the first hold member 5 and the second hold member 6 toward one another such that the holding surfaces 8, 9, 11, 12 hold both sides of the leaf paper P (FIGS. 5 and 16).

Figure 17:
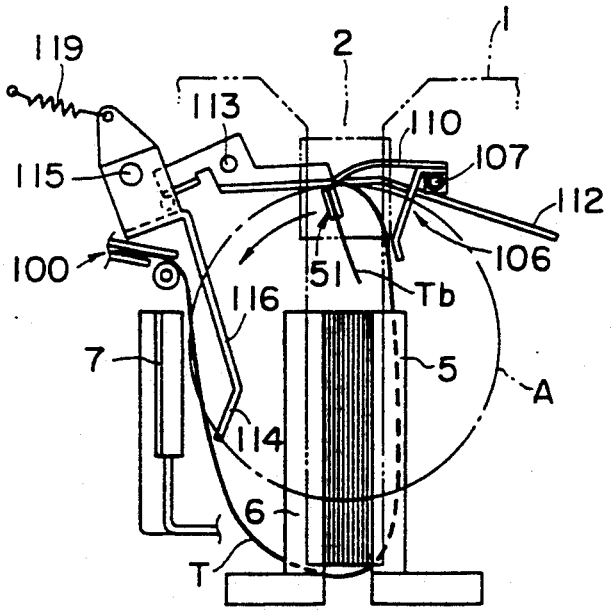
FIG. 17 is a similar view showing the arm beginning to orbit.
Figure 18:
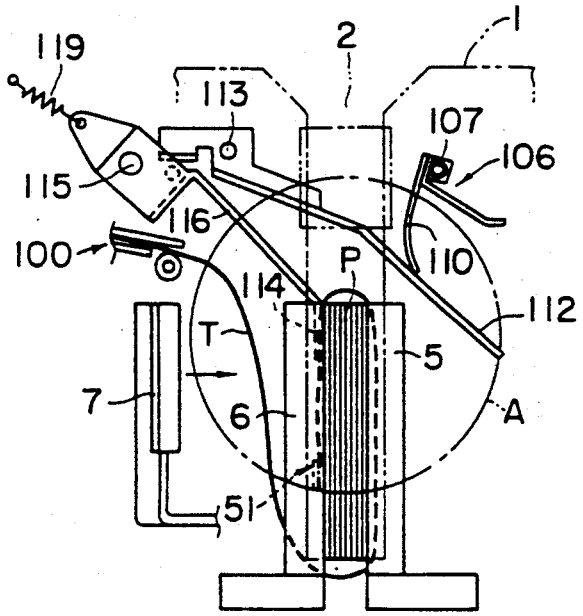
FIG. 18 is a similar view showing the arm at its limit position with respect to the leaf paper.

After this, the arm 51 of the tape wrapping means 50 is again moved along path A and so presses the straightening arm 110 of the tape straightening plate 106 out of the way, and as shown in FIG. 17, passes under the operation lever 112 of the leaf paper pressing mechanism 111 to the opposite side of the stack of the leaf paper P. The arm 51 eventually moves out of contact with the surface of the operation lever 112 so that as shown in the FIG. 18, the leaf paper pressing lever 116 is rotated counterclockwise by the spring 119, and the pressing portion 114 presses the upper side portion of the stack of leaf paper P so that differences in the forces exerted at the top of the leaf paper P are prevented.

Figure 19:
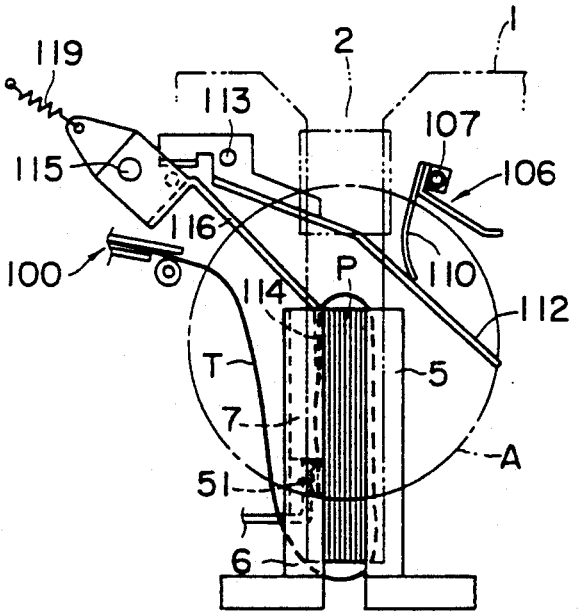
FIG. 19 is a similar view showing the leaf paper held by the third hold means.

Then, the roller 34 of the lever 13 rotates the lever 13 by traversing the elongate hole 39 of the drive member 40 of the relay mechanism 35 and the third holding member 7 is brought into contact with the leaf paper P (See FIG. 6). Accordingly, the holding surfaces 8, 9, 11, 12, 32 of the first hold member 5, second hold member 6 and third holding member 7 engage the side surfaces of the leaf paper P (FIG. 19).

Figure 20:
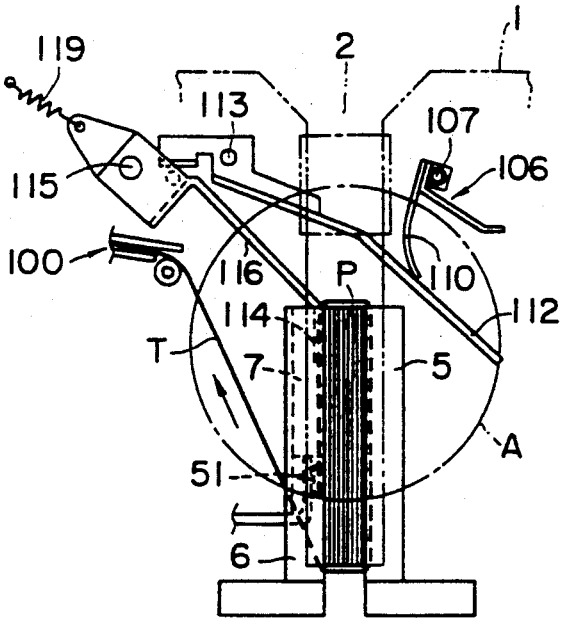
FIG. 20 is a similar view showing the state wherein the tape is tensioned.
Figure 21:
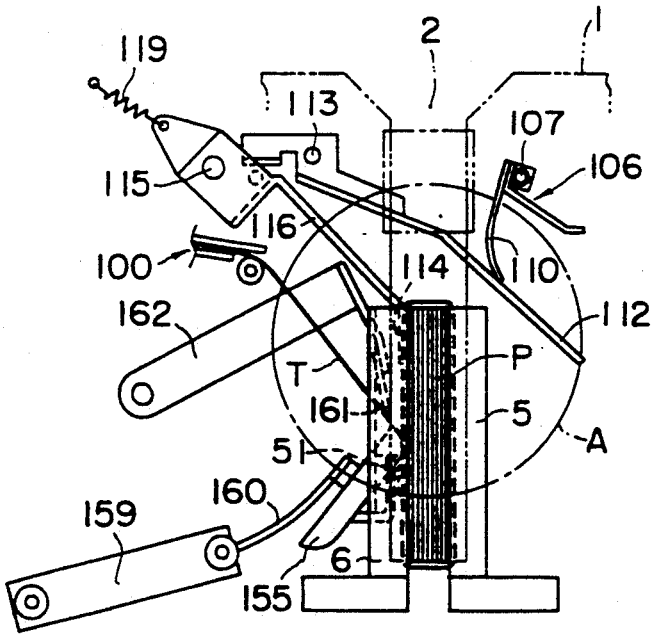
FIG. 21 is a similar view showing the start of thermal adhesion and the state wherein the tape is cut.

Then, the roller 102 of the tape supply means 100 rotates in reverse to tension the tape T (FIG. 20) and the head 155 presses portions of the tape T together as the adhesion of these portions start, the cutter 161 starts to cut the tape T, and the head 155 advances further s that the cut end of the tape T is rubbed upwards and thermally adhered to the lead end of the tape T (FIG. 21). After this, when the cutter 161 and the head 155 return to their original positions, the moving frame 56 is retracted by the moving mechanism 69, the arm 51 is moved backwards, and the leaf paper bundling operation is completed. Moreover, the arm 51 stops at the position shown in FIG. 21. Then, the cam member 19 also returns to its initial position and each of the first holding member 5, second holding member 6 and third holding member 7 return to their initial positions whereby the leaf paper P is released, the shutter plate 136 opens and it is possible for the bundled leaf paper to be removed.

When the bundled leaf paper P is removed, the shutter plate 136 again closes and the arm 51 moves from the position shown in FIG. 21 to the tape receiving position shown in FIG. 14. The arm 51 returns in the forward direction to the tape receiving position. Then, the roller 102 of the tape supply means 100 rotates forward after it has rotated once in reverse and feeds the tape T so that, as has already been described, the tape T is held by the arm 51 in the standby position prior to its movement to the position shown in FIG. 15.

Figure 24:
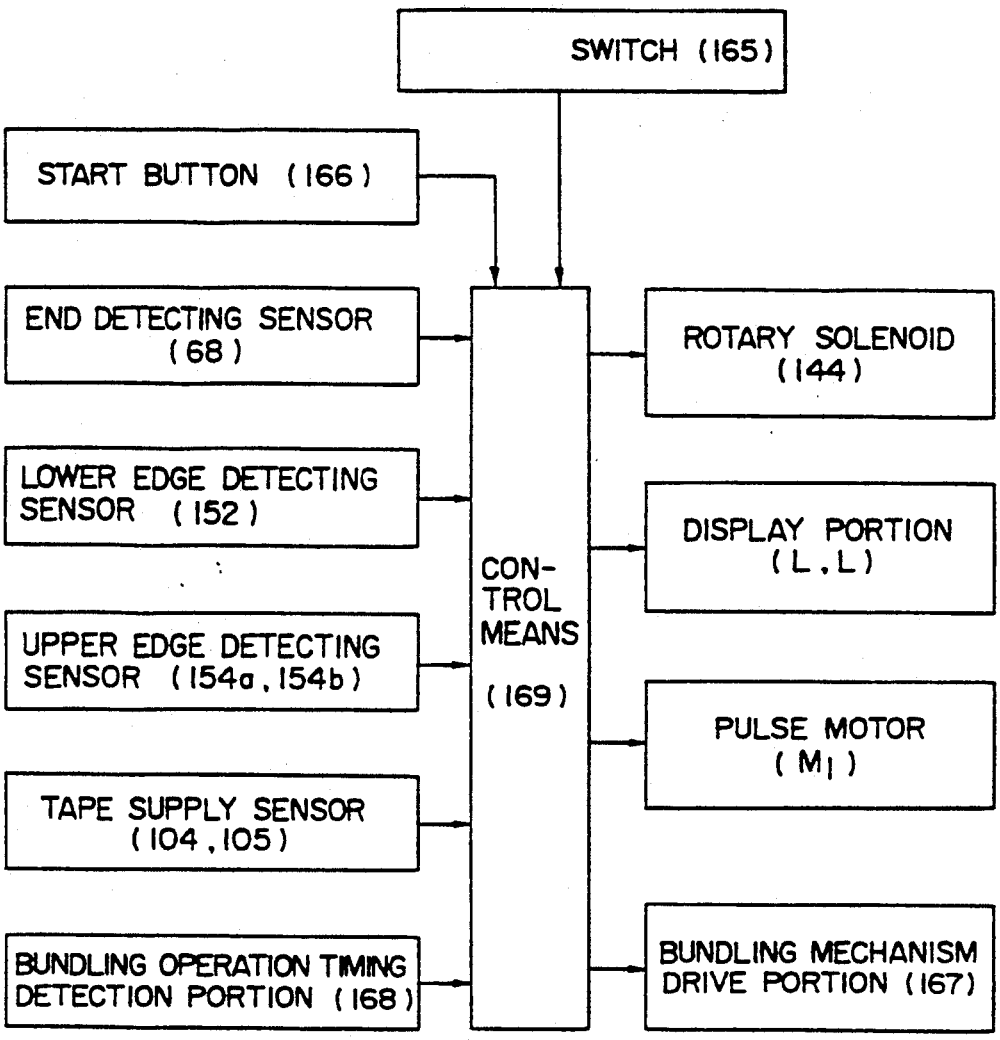
FIG. 24 is a control block diagram.
Figure 25:
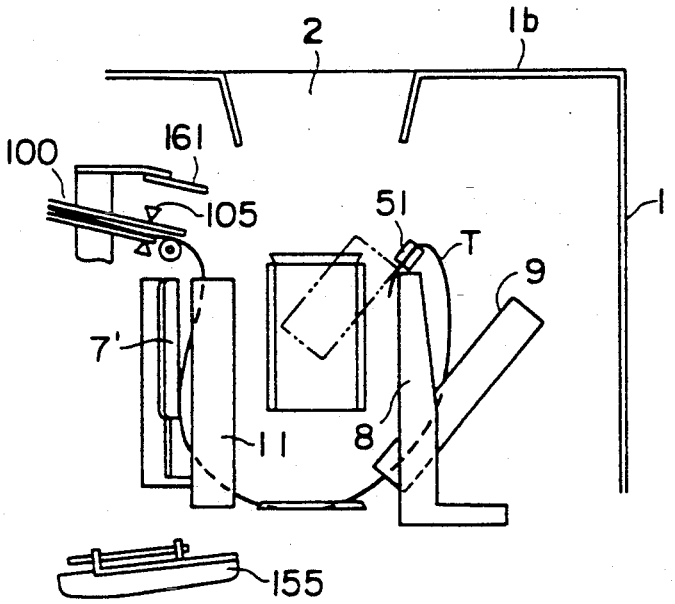
FIG. 25 is a view corresponding to FIG. 15, but showing another embodiment of the present invention.
Figure 26:
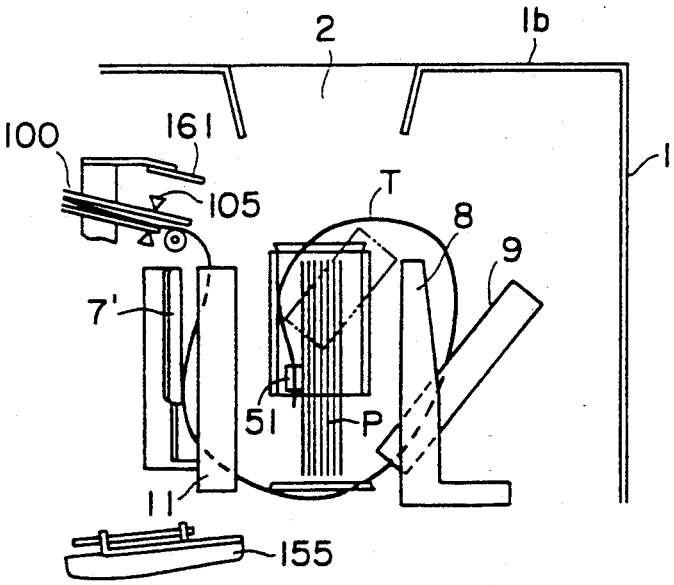
FIG. 26 is a view corresponding to FIG. 18.

The switch 165 shown in FIG. 24 switches between an automatic start mode in which the sensors 68, 152, 154*a*, 154*b* are operative to sense the leaf paper P, and a start button mode by which the operation can be started by a start button 166 once there is detection of the leaf paper P by the sensors 68, 152, 154*a*, 154*b*.

As also shown in FIG. 24, in addition to the holding members 5, 6, 32, the leaf paper pressing lever 116, and the arm 51, a bundling mechanism drive portion 167 including a motor, a solenoid 80 for opening and closing the arm 51, the motor for driving the head 115 and the cutter 161, and a movement solenoid and the like is controlled by control means 169.

In addition, a bundling operation timing detection portion 168 detects the operation timing of the entire bundling apparatus and, for example, includes a rotation angle position detection sensor (i.e. a sensor for the detecting the tape receiving position and the standby position B) of the arm 51. The control means 169 receives the input of each of the sensors 68, 152, 154*a*, 154*b*, 104, 105, the detection portion 168, the start button 166, and the switch 165, and operates the solenoid 144, the display portion (L, L), pulse motor connected to the roller 102, and the bundling mechanism drive portion 167.

Figure 27:
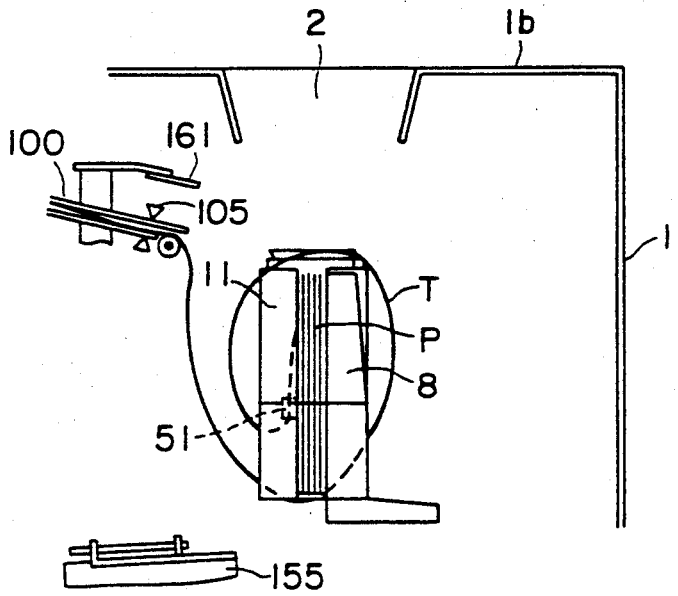
FIG. 27 is a view corresponding to FIG. 19.
Figure 28:
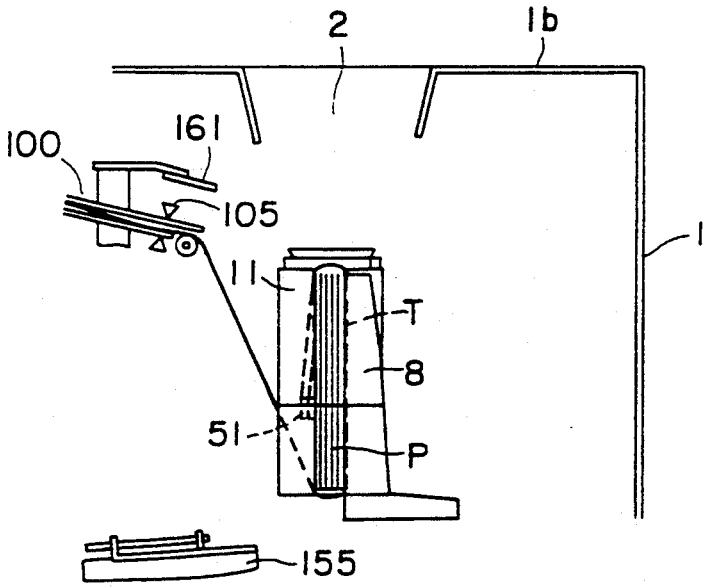
FIG. 28 is a view corresponding to FIG. 20.
Figure 29:
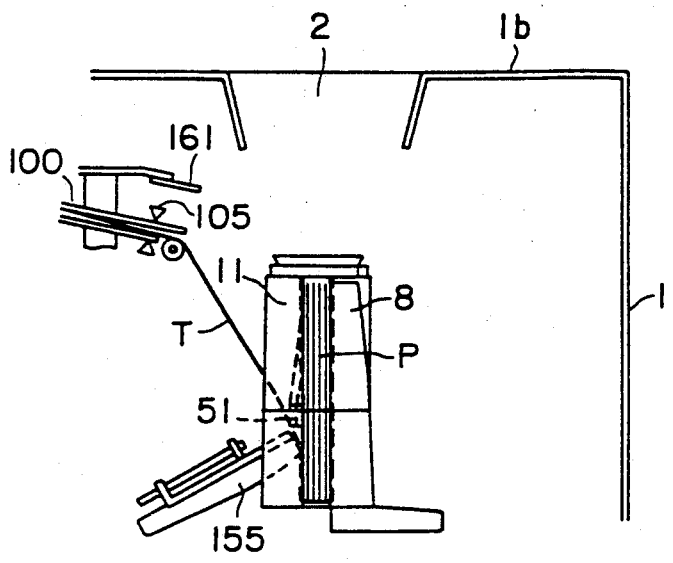
FIG. 29 is a view corresponding to FIG. 21.
Figure 30:
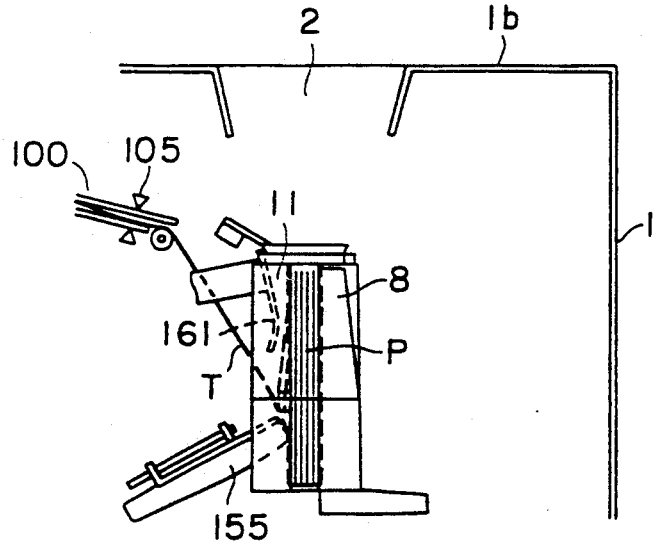
FIG. 30 is a view corresponding to FIG. 21.
Figure 31:
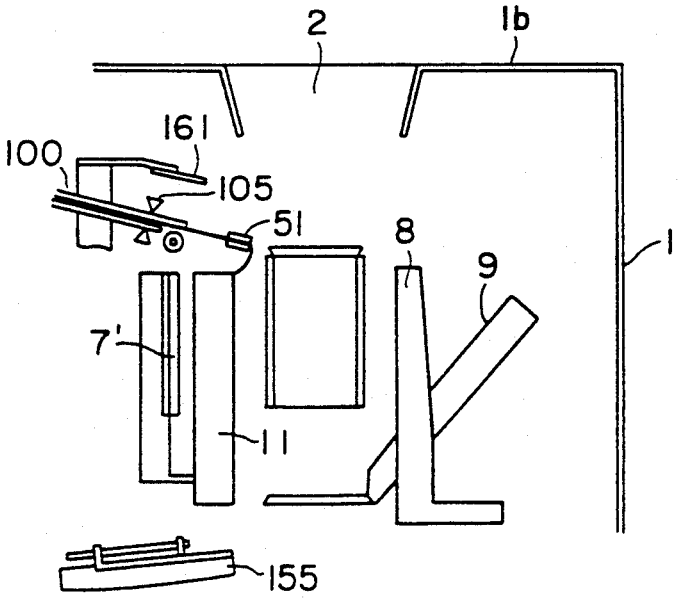
FIG. 31 is a view corresponding to FIG. 14.

FIG. 25 through FIG. 31 show another embodiment of the present invention, and those portions that correspond to the embodiment described above are indicated with corresponding numerals and the corresponding descriptions of them are omitted. In this embodiment, the holding surface 9 together with the holding surface 8 are rocked so that they do not interfere with the movement of the fixed arm 52 and the moving arm 53. Further, there is no holding surface corresponding to the holding surface 12 in the first embodiment. The leaf paper P is first held by holding surfaces 8 and 9 after the arms 52 and 53 have wrapped the tape T around the leaf paper P and third holding member 7' is in contact with the leaf paper surface (FIG. 27 and FIG. 31). The other portions of this embodiment are the same as those of the previous embodiment. In passing, FIG. 25 corresponds to FIG. 15, FIG. 26 to FIG. 18, FIG. 27 to FIG. 19, FIG. 28 to FIG, 20, and FIGS. 29 and 30 correspond to FIG. 21, and FIG. 31 corresponds to FIG. 14.

Figure 32:
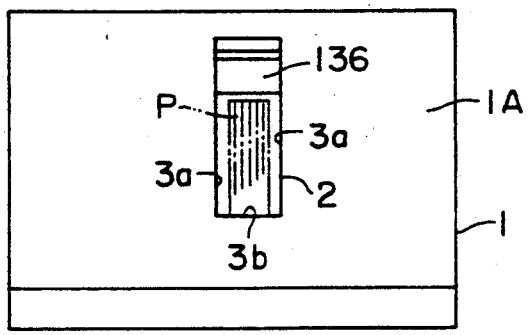
FIG. 32 is a frontal elevational view of another embodiment of the present invention.
Figure 33:
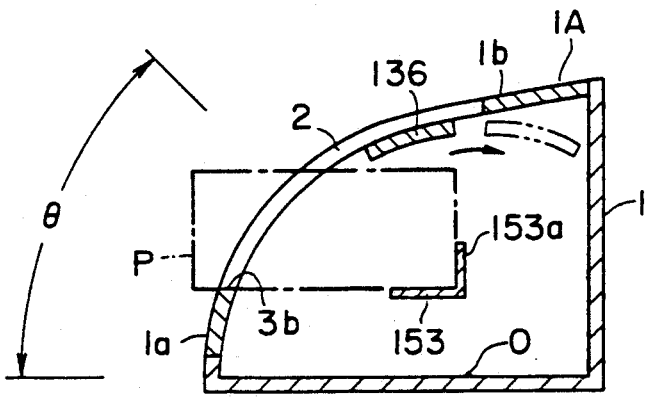
FIG. 33 is a longitudinal sectional view of the embodiment shown in FIG. 32.

FIGS. 32 and 33 respectively show another embodiment of the present invention characterized by the shape of the leaf paper insertion opening portion 2. In particular, FIG. 32 is a front view of the main apparatus unit 1 and FIG. 33 is a longitudinal sectional view taken through the center of the leaf paper insertion opening portion 2 shown in FIG. 32. In this embodiment, those portions that correspond to the embodiment described above with respect to FIG. 1 (B) are designated with corresponding numerals and the corresponding descriptions of them are omitted.

In this embodiment, the front cover 1A has an inclined surface that is a continuation of the curved surface of the front cover. Thus, there is no clear division of the front surface 1*a* and the top surface 1*b* of the main apparatus unit 1. In this example, the front portion of the main apparatus unit subtends an angle $\theta$ of approximately 45° about the center point O in FIG. 33. In addition, the leaf paper insertion opening portion 2 defines a slit-shaped opening in the form of an arc in this embodiment.

The present invention is, however, not limited to the embodiments described above. In particular, the leaf paper bundling apparatus described in the embodiments is an apparatus that bundles Japanese banknotes of each denomination, (for example ¥10,000, ¥5,000, ¥1,000 notes). Because these banknotes each have the same width (the short direction of the banknote), the sensors 154*a*, 154*b* need only be provided as fixed in position one above the other. However, if banknotes of other countries and that have different widths are to be bundled, it is necessary to provide top and bottom position adjusters for adjusting the position of the sensors (154*a*, 154*b*) so that the banknotes of various widths can be detected. Alternatively, a plurality of sensors (154*a*, 154*b*) can be provided in correspondence with the number of different types of banknotes. The application of the present invention is not limited to bundling banknotes; promissory notes, checks, dockets, for example, and other types of leaf paper can also be bundled.

In the embodiments of the present invention, the main unit apparatus includes a front cover that can be opened and closed, and the leaf paper insertion opening portion is formed in the front cover. However, a front cover is not necessary and the leaf paper insertion opening portion can be made integral with the body of the main unit apparatus. Furthermore, the leaf paper regulating means and the leaf paper insertion detection means are also not limited to the types described above in connection with the preferred embodiments.

Also, when it is necessary to change the bundling position in accordance with the length (i.e. the long dimension of the leaf paper) and the width (i.e. the short dimension of the leaf paper) of the leaf paper, the position of the leaf paper regulating means and the leaf paper insertion detection means may be adjustable. For example, in FIG. 23, the leaf paper detection plate 62 and the positioning plate 153 can be supported so as to be adjustably movable to the left and right, and the sensors 154*a*, 154*b* can be supported so as to be adjustably movably up and down. Further, the amount of tape supplied by the rollers 102, 103 can be adjusted, accordingly. Thus, the bundling position is not necessarily limited to a fixed position.

Also, with respect to the holding means, a first group of surfaces that engage the stack of leaf paper consist of the holding surface 11 and the opposing holding surface 8, and the lower half of the holding surface 9 and the opposing holding surface 12, whereas a second group of surfaces consist of the upper half of the holding surface 9 and the opposing holding surface 32. However, a separate member can be configured to correspond to the top and bottom of the holding surfaces 8,11, so as to constitute the second group of surfaces.

In addition, the terms "the detection by the leaf paper insertion detection means", and "on the basis of detection of leaf paper by said leaf paper insertion detection means" refer to both the operation initiated by output of the leaf paper insertion detection means and the operation that is initiated by both this detection output and the output of a start button.

According to the present invention, in a leaf paper bundling apparatus which wraps a tape around many leaves of paper which have been stacked, uses a cutter to the tape and a thermo-adhesion head to thermally adhere cut ends of the tape to one another so as to bundle leaf paper, it is possible for the leaf paper to be inserted into the leaf paper bundling apparatus in either the horizontal direction from the front or in the vertical direction from the top of the apparatus, whereby the apparatus is convenient to use. The leaf paper inserted in either direction is positioned by a regulating means so that no obstruction to the bundling operation is presented. According to the present invention, the bundling operation is performed only when the inserted leaf paper is at a set position so there will be no deviation of the tape from the set position during wrapping. Thus, leaf paper bundles are produced that are uniform and are reliably bundled. Furthermore, after the leaf paper has been inserted, the holding means that holds the leaf paper facilitate tape tightening. Therefore, the operating mechanism is not complex, and the apparatus is relatively compact.

We claim:

1. A leaf paper bundling apparatus for bundling a stack of leafs of paper, said apparatus comprising:

a main apparatus unit being box shaped and including a front portion facing generally forwardly and an upper portion facing generally upwardly in the apparatus;

a leaf paper insertion opening portion integral with said main unit and defining a slip open to the interior of said unit, said slit extending longitudinally, in a vertical plane, both through said front portion of said main unit and at an angle relative to said front portion through said upper portion of said main unit so that a stack of leaf paper can be inserted into the main unit and into a bundling position through said slit in both a vertical direction through the upper portion of said main unit and a horizontal direction through the front portion of said main unit;

a leaf paper position regulator disposed in said main unit opposite said front portion thereof to receive a lower edge of a stack of leaf paper inserted into the main unit through either the front or the upper portion thereof via said leaf paper insertion opening portion and to receive a vertical edge of the stack of the leaf paper located farthest from the front portion of the main unit when so inserted, thereby positioning the inserted stack of leaf paper at the bundling position;

a tape supply device within said main apparatus unit and which is operative to supply tape for bundling the stack of leaf paper and apply tension to the tape supplied;

a leaf paper insertion detector which detects whether the stack of leaf paper is in the bundling position;

a tape wrapping device within said main apparatus unit, said tape wrapping device including an arm adapted to hold a lead end of the tape, said arm supported for orbital movement along an endless path including a tape receiving position adjacent the tape supply device such that the arm is operative to hold a lead end of tape supplied by the tape supply device and a standby position from which the arm can wrap the tape held thereby around a stack of leaf paper in the bundling position, and a moving mechanism connected to said arm so as to move said arm from said standby position and along said endless path;

said moving mechanism and said tape supply device being operatively connected to said leaf paper insertion detector so that the supplying of tape to said arm and the movement of said arm about said endless path is coordinated with the insertion of the stack of leaf paper to the bundling position in a manner in which the supplying of the tape by the tape supply device and the movement of said arm do not interfere with the insertion of the stack of leaf paper to the bundling position, and the tape is wrapped around the entirety of the periphery of the stack of leaf paper in the bundling position by the tape wrapping device;

a leaf paper holding device disposed within the main apparatus unit, and which holds a stack of leaf paper in the bundling apparatus along two opposing side surfaces of the stack at location proximate where sides of the tape lie when the tape is wrapped around the leaf paper by the tape wrapping device;

a cutter disposed within the main apparatus unit, and which cuts a trailing end of tape wrapped around a stack of leaf paper in the bundling position; and a thermal held within the main apparatus unit, and which adheres ends of the tape wrapped around the stack of leaf paper to one another.

2. A leaf paper bundling apparatus as claimed in claim 1, wherein said leaf paper holding device includes a plurality of holding members which hold the stack of leaf paper in the bundling position along both side surfaces of the stack at locations proximate where the sides of tape will lie when the tape is wrapped around the stack of leaf paper, and a holding member moving mechanism connected to said holding members and which holding member moving mechanism is operative to move at least some of said holding members to holding positions in contact with the stack of leaf paper in the bundling position, said holding member moving mechanism of the holding device being operatively connected to said leaf paper insertion detector so as to move the at least some of the holding members to the holding positions once the stack of leaf paper is detected by said leaf paper insertion detector.

3. A leaf paper bundling apparatus as claimed in claim 2, wherein said at least some of the holding members having a first group of surfaces that contact the side surfaces of the stack of leaf paper when the at least some of the holding members are in the holding positions, and said holding member moving mechanism is operative to move others of said holding members into holding positions after the tape is wrapped around the periphery of the stack of leaf paper by the tape wrapping device, said others of said holding members having a second group of surfaces which contact the side surfaces of the stack of leaf paper in the bundling position when the others of said holding members are in the holding positions thereof.

4. A leaf paper bundling apparatus as claimed in claim 3, wherein said leaf paper insertion detector includes detectors positioned to detect the lower edge and the vertical edge of a stack of leaf paper inserted into the main apparatus unit to the bundling position.

* * * * *